US009408427B2

(12) United States Patent
Mills et al.

(10) Patent No.: US 9,408,427 B2
(45) Date of Patent: Aug. 9, 2016

(54) SNAP INSTALLATION TOOL ADAPTOR

(76) Inventors: David Mills, Center Ossipee, NH (US); William R. Deware, Belmont, NH (US)

( * ) Notice: Subject to any disclaimer, the term of this patent is extended or adjusted under 35 U.S.C. 154(b) by 841 days.

(21) Appl. No.: 13/585,906

(22) Filed: Aug. 15, 2012

(65) Prior Publication Data

US 2013/0075442 A1 Mar. 28, 2013

Related U.S. Application Data

(60) Provisional application No. 61/523,450, filed on Aug. 15, 2011.

(51) Int. Cl.

| | |
|---|---|
| ***A41H 37/00*** | (2006.01) |
| ***B25C 7/00*** | (2006.01) |
| ***B25C 1/00*** | (2006.01) |
| ***B25C 1/02*** | (2006.01) |
| ***A41H 37/04*** | (2006.01) |

(52) U.S. Cl.

CPC ..... *A41H 37/04* (2013.01); *A41H 37/005* (2013.01)

(58) Field of Classification Search

CPC ..... B25C 7/00; B25C 1/00; B25C 1/02; A41H 37/00; A41H 37/04; A41H 37/005

USPC ..... 227/15, 18, 31, 38

See application file for complete search history.

(56) References Cited

U.S. PATENT DOCUMENTS 3,581,373 A * 6/1971 Murdoch et al. ..... B21J 15/02 29/243.54

5,463,807 A * 11/1995 Hochhausl ..... 227/15

* cited by examiner

*Primary Examiner* — Michelle Lopez

(74) *Attorney, Agent, or Firm* — Michael Persson; Catherine Napju; Lawson Persson Weldon-Francke P.C.

(57) ABSTRACT

The present invention includes a snap installation adaptor designed to be united with a handheld tool so that the union can permanently affix snaps onto fabric. The snap installation adaptor includes an upper portion with a cap node; a lower portion with a socket node; an intermediate portion connecting the upper and lower portions; and means for transferring external downward force from the handheld tool through the upper portion so that the cap node is forced to meet the socket node, thus permanently affixing a snap onto a piece of fabric between the upper and lower portions.

27 Claims, 15 Drawing Sheets

SNAP INSTALLATION TOOL ADAPTOR

CLAIM OF PRIORITY

This application claims the benefit of priority of U.S. Provisional Patent Application Ser. No. 61/523,450 filed on Aug. 15, 2011.

FIELD OF THE INVENTION

The present invention relates to snap installation tools, and in particular, to plug-in adaptors adapted to be attached to existing power tools to make them capable of performing snap installations.

BACKGROUND

Snaps are a common fastener used in many applications, from clothing to large fabric coverings. In particular, snaps may be used to secure protective canvas coverings for boats, tractors, walk-behind snowplows, and the like. In these latter applications, snaps are installed on the canvas so as to be able to attach the canvas to the frame of the item to be covered. The frame will include one side of the snap and the canvas the other. Typically, the frame includes the male portion of the snap, and the canvas the female portion. The female portion includes a cap on one side of the canvas or other fabric, and a socket on the other. The socket is adapted to fit into the cap with the fabric between the socket and the cap, forming the female portion of the snap. The female portion may then mate with the male portion of the snap to complete the fastening. In some applications, the male portion is also mounted on a fabric or canvas by a similar method of pressing the fabric between male caps and sockets.

FIGS. 1A and 1B depict the various pieces involved in snap installation. Fabrics 60 and 62 are to be made to be attachable to one another by snap 46. It is understood that in many instances in practice, the male portion of the snap will be permanently affixed to a hard surface, such as a boat. In this illustration both the male and female snap portions are affixed to pieces of fabric 60, 62 so as to show all possible pieces of snap 46. Female cap 52 and female socket 54 are placed on either side of fabric 60 in a location corresponding to the location of male cap 56 and male socket 58 on fabric 62. Female cap 52 includes pusher 53 that is adapted to push fabric 60 through and mate with hole 55 of female socket 54 (shown in FIG. 1D). Sufficient force must be provided to force female cap 52, fabric 60, and female socket 54 together permanently. Female socket 54 includes a recessed portion depicted in FIG. 1A by dotted lines.

In FIG. 1B, the female and male portions of snap 46 have been affixed to fabric 60 and 62, respectively. FIG. 1B shows integrated female portion 48 and integrated male portion 63. Integrated female portion 48 is female cap 52 and female socket 54, as shown in FIG. 1A, after sufficient force has been applied to permanently mount the female portion of snap 46 onto fabric 60. Integrated male portion 63 is male cap 56 and male socket 58, as shown in FIG. 1A, after sufficient force has been applied to permanently mount the male portion of snap 46 onto fabric 62. As with the female cap 52 and female socket 54 shown in FIG. 1A, dotted lines show that male cap 56 includes an interior hollow portion adapted to mate with male socket 58 through fabric 62. Integrated male portion 63 is placed on either side of fabric 62 in a location corresponding to the location of integrated female portion 48 on fabric 60. Again, sufficient force must be provided to force male cap 56, fabric 62, and male socket 58 together permanently.

FIG. 1C is a perspective view of female cap 52, including pusher 53 and cap rim 57. FIG. 1D is a top down view of female socket 54, including hole 55 and socket rim 59. Although not obvious from the top down view of FIG. 1D, hole 55 is recessed below socket rim 59, as indicated by dotted lines in FIG. 1A.

The mounting of a female or male snap portion onto fabric or canvas requires the use of a tool designed specifically for this purpose. The standard prior art for this purpose is a vice grip type tool that requires the installer to grip the tool with his hand and apply a large amount of squeezing force to securely rivet the cap to the socket. FIG. 2 shows an example of a prior art vice grip type tool. This tool includes a rubber receiver 51 within the metallic top portion of the vice. During snap installation, a female cap 52 is placed within rubber receiver 51 prior to the application of force on the tool. The placement of female cap 52 within rubber receiver 51 is difficult and imprecise. The user must wiggle the female cap 52 around until it seems properly placed within the rubber receiver 51. Often, despite this effort, the female cap 52 is not properly placed, leading to misalignment with the female socket 54 after application of force onto the tool, and the necessity to redo that snap installation in addition to damage to the fabric 60 which will have been unnecessarily punctured. Moreover, the wiggling around of the female cap 52 within the rubber receiver 51 results in the rubber receiver 51 wearing down quickly.

In addition to this design flaw, the force required to properly operate a prior art tool is extremely fatiguing, especially considering that some applications require that the snap be installed through up to four layers of material. This is particularly true for applications requiring the installation of many snaps, such as with a canvas to cover a large boat. The average boat canvas requires the installation of approximately eighty snaps. Even for someone with good strength and dexterity in his hand, this repetitive motion can become difficult, but this is particularly true for those with limited strength or dexterity in their hands. It is well known throughout the canvas enclosure business that the repetitive, excessive squeezing force required to perform this task can lead to injuries to the hand and forearm such as tendinitis, arthritis, bursitis, etc. . . . Therefore there is a need for a snap installation tool that provides the necessary force from a source other than the human hand. Such a source may be electric, pneumatic, or hydraulic, for example.

Electric, pneumatic, and/or hydraulic snap installation devices do exist. U.S. Pat. No. 4,090,652 to Silverbush, for example, discloses a snap fastener attaching system whose operation and control is implemented by means of a control sequencer that can operate by means of electronic or electromechanical relays or by pneumatic devices. The snap fastener attaching system employs a movable carriage assembly that is controlled in linear motion by a belt system coupled to an actuator mechanism. The carriage assembly includes clamping means that are sequentially operated to clamp a garment on the assembly after emplacement by an operator. Although this snap fastener attaching system uses power other than the human hand to provide the force necessary for the snap installation, it is a large, complicated, and stationary device that is ill suited for use in the field, particularly for large applications, such as a canvas boat cover, where the device may need to be moved and set up repeatedly in different locations about the cover.

U.S. Pat. No. 5,463,807 to Hochhausl also discloses an automated attaching machine for attaching fasteners. In this invention, support means carry an upper and lower tool assembly; upper and lower fastener part feed means; and pusher and tool drive means. The upper and lower tool assembly comprises an upper and a lower forward arm rigidly secured in spaced parallel relation by a bridging neck connecting the rear of the arms. The forward ends of the arms carry respectively the axially aligned upper punch and the lower die and the upper, and lower forward arms are horizontally slotted and slidably receive upper and lower pusher elements respectively. The feed means comprises removable hoppers and track which are hung on the support means and conduct the parts respectively to the pusher slots in the arms. The upper and lower tool assembly is removably secured in an opening in the frame or support means and the tool drive means respectively releasably operatively engages the upper punch and the lower die and the pusher drive means releasably operatively engage the upper and lower pusher elements. Preferably, as the tool assembly is installed in its opening, the tool drive means automatically engages the punch and die. By virtue of this structure, the integral upper and lower tool assembly can be released from the drive means and removed readily from its secured position in the support means and readily replaced by a different tool assembly to accommodate different fastener parts. Although this invention does not require hand strength and dexterity to install snap fasteners, it is also a large, stationary machine that is not easily transportable and could not easily be used in the field.

In addition to these stationary machines that use a force other than that of a human hand to install snaps, there exist many handheld power tools that use electricity, pneumatics, and/or hydraulics for force. Common examples of these include nail guns, staple guns, and the like. U.S. Pat. No. 6,729,104 to Marshall also discloses a pneumatic crimping and capping handheld tool, which teaches a hand-held, power-operated or power-assisted, crimping/er or decapping/er tool, for container closures, such as vial caps, has a hollow handle, housing a (pneumatic) piston-in-cylinder actuator, with an external trigger operating an internal control valve, to control connection of an external pressure supply, through an internal distribution block, and displacement of an actuator output rod, coupled, through a pivoted bell crank lever, to a demountable crimper or decapper. No such handheld power tool for snap installation exists, however. U.S. Pat. No. 4,090,652 to Silverbush; U.S. Pat. No. 5,463,807 to Hochhausl; and U.S. Pat. No. 6,729,104 to Marshall are hereby incorporated by reference as nonessential material.

Thus there is a need for a handheld power tool adapted for snap installation and for repetitive use in the field.

SUMMARY OF THE INVENTION

The present invention includes a snap installation adaptor, a snap installation kit, and a method for adapting a handheld power tool for use as a snap installation tool.

In its most basic form, the present invention includes a snap installation adaptor. The snap installation adaptor is an adaptor that may be used for snap installation. It is designed to be easily attached to the body of a handheld power tool so that the handheld power tool may be used as a snap installation tool.

The preferred existing handheld power tool that may be used is a handheld impact torque driver. However, it is understood that many battery, electric, pneumatic, and/or hydraulic powered handheld tools may be used, either in their original state or in a modified states, to accomplish this purpose. In some embodiments, the handheld tool may have an automatic feed so that the operation of the handheld tool may be continuous. Moreover, although triggers are referred to as the common operation inducer for the handheld tools that may be used in connection with the snap installation adaptor, it is understood that other art recognized operation inducers, such as switches or buttons, may be used in some embodiments of the present invention. Herein "trigger" refers to all such art recognized operation inducers.

The snap installation adaptor has an upper and lower portion connected by a preferably curved intermediate portion so that there is an opening between the upper and lower portion. The upper portion attaches to the existing handheld power tool body. In some embodiments, this attachment is by a screw through the upper portion that secures it to the handheld power tool body, but may be by any manner that will adequately attach the snap installation adaptor to the handheld power tool body such that the tool driving apparatus of the handheld power tool body may be used to drive the snap installation function of the snap installation tool, which is the integrated handheld tool and snap installation adaptor.

The upper portion includes a cap node where the cap part of a female or male portion of a snap may be held for installation. The tool driving apparatus of the handheld power tool to which the snap installation adaptor is attached will drive the cap down onto a fabric placed between the cap part and a socket part held by the lower portion of the snap installation adaptor so that the snap portion may be installed on the fabric. The cap node preferably includes an o-ring that allows the cap to be easily snapped into and out of the cap node. The cap node of the present invention represents a substantial improvement over those used in prior art devices and it is envision that the cap node of the present invention will be sold as a separate replacement part to replace existing cap nodes.

The cap node of the present invention may include an improved placement device for placing the female cap prior to snap installation. The improved placement device may be a weakly spring loaded device that will hold the female cap in alignment with the lower portion prior to snap installation, but will not hold it so firmly that it does not easily release upon installation. The improved placement device may also be a device including a ball bearing or a magnet so as to hold the female cap in place.

The lower portion of the snap installation adaptor is positioned directly opposite from the upper portion and may include a threaded tube, a threaded screw, and a socket node. The threaded tube extends vertically through the lower portion and is adapted to accept the threaded screw. The threaded screw is positioned through the threaded tube so that the length of the threaded screw within and outside of the threaded tube may be adjusted so that more or less of the threaded screw may extend into the opening between the upper and lower portions of the snap installation adaptor. The end of the threaded screw that extends into the opening has a socket node where the socket part of a female or male portion of a snap may be held for installation. The threaded screw and threaded tube are so positioned within the lower portion of the snap installation adaptor that when the threaded screw is extended to its extreme through the opening between the upper and lower portions, the socket node of the lower portion and the cap node of the upper portion will meet.

The intermediate portion may include an attached or integral preferably 1-shaped bracket for reinforcement.

In practice a fabric or canvas that is to have snaps installed on it will be placed in the opening between the upper and lower portions of the snap installation adaptor. The distance between the cap and socket nodes may be adjusted so that fabrics of varying thickness or with one or more folds may be placed within the opening. When the proper location for the female portion of the snap is located between the cap and socket nodes, a user of the snap installation tool depresses the trigger and sufficient force is applied down from the cap node to install the cap and socket on either side of the fabric between the cap and socket nodes.

In the preferred embodiment of the present invention, the handheld tool is a right angle 12 volt impact driver torque 700 in. lbs. sold under the trademark CRAFTSMAN. In this embodiment the upper portion, lower portion, and intermediate portion are combined into an integrated block, which is approximately C-shaped. The upper portion includes the cap node. The lower portion includes the socket node and a threaded screw for adjusting the distance between the cap node and the socket node. The preferred snap installation adaptor also includes a driving apparatus extension, which includes features for transmitting the force of the handheld tool through the upper portion and down onto the lower portion so as to affix snaps to a piece of fabric between the upper and lower portions. The driving apparatus is attached to and above the upper portion, and is preferably also integrated into the integrated block. The driving apparatus extension houses stop pins, a screw shoulder, a drive rod hole, a threaded drive screw, a ball, and an o-ring lock. The driving apparatus extension and these features that it houses act as a means for transferring the handheld power tool's external downward force through the upper portion so that the snap may be installed.

The stop pins stop the screw shoulder from extending too far up through the driving apparatus extension. The threaded drive screw moves in concert with the screw shoulder and extends from the screw shoulder down to the cap node in the upper portion. The threaded drive screw houses the drive rod hole, the ball, and the o-ring lock, so that all of these features, as well as the cap node move up and down together as pressure is applied from the handheld tool when the snap installation adaptor and the handheld tool are united. The drive rod hole runs down through the driving apparatus extension toward the upper portion, through the threaded drive screw, and ending at the ball. The drive rod hole is sized and dimensioned to snugly surround the drive rod of the handheld tool. The ball is hard enough to withstand the repeated intense downward thrust and spin of the drive rod without undergoing significant degradation. The purpose of the ball is to prevent rotation of the cap node during installation and this anti-rotation feature is an important aspect of the invention when a rotating driver is utilized. The drive screw imparts both downward and rotational forces during operation and, by creating only point contact with both the drive rod and the cap node, the ball effectively prevents the rotational forces from being imparted to the cap node. The ball is locked in place by the o-ring lock, which is preferably made of rubber.

The preferred snap installation adaptor also includes a laser sight that allows a user to see exactly where on a piece of fabric the snap will be installed. The preferred snap installation adaptor also includes a support rod, which provides support between the snap installation adaptor and the handheld tool when they are integrated. The support rod is preferably made of plastic tubing that is approximately 6.75" long and has an inner diameter of approximately ½".

The drive rod is attached to the handheld tool at a collet. When the handheld tool and the snap installation adaptor are united, the drive rod drives down and twists into the driving apparatus extension, through the drive rod hole within the threaded drive screw until it contacts the ball. This causes the threaded drive screw, which is in contact with the cap node to move downward to meet the socket node and permanently affix both sides of a female or male portion of a snap to either side of a piece of fabric. The handheld tool and the snap installation adaptor are attached by pins and removable bands. The removable bands wrap around the handheld tool and hook onto the pins on the snap installation tool. The bands are removable to separate the handheld tool and the snap installation adaptor as necessary.

In an alternative embodiment of the preferred embodiment of the present invention, the handheld tool is again a right angle 12 volt impact driver torque 700 in. lbs. sold under the trademark CRAFTSMAN. Although the CRAFTSMAN brand right angle impact driver is preferred, a standard hammer angle drill, a straight hammer drill, or a regular drill modified for higher torque may be substituted. This preferred snap installation adaptor includes a driving apparatus extension connected to the handheld tool's tool driving apparatus, and an integrated block connected to the driving apparatus extension that includes the upper portion with the cap node, the intermediate portion connecting the upper portion and lower portion, and the lower portion with the socket node. The integrated block is roughly C shaped. It also includes a laser sight and may include a block support. The laser sight is preferably connected to the integrated block and, during use, provides a laser indicator on the fabric between the cap node and socket node indicating to the user exactly where the snap will be installed. When connected to the integrated block, the laser sight may be encased in a laser sight cover to protect the laser sight. Alternatively, the laser sight may be attached to or embedded within any other feature of the snap installation adaptor as long as the laser sight's presence and position does not interfere with the function of that feature and as long as the laser sight's position allows for the function of the laser sight as described above.

The driving apparatus extension connects the tool driving apparatus, in this case preferably a drill driver, with the cap node so that the force of the handheld tool, in this case preferably a right angle impact driver, is used to install snaps. The driving apparatus extension is directly connected to the tool driving apparatus by a hex driving bit surrounding a spindle. Again, the driving apparatus extension acts as a means for transferring the handheld power tool's external downward force through the upper portion. This allows the rotating action of the tool driving apparatus to be extended beyond the handheld tool. Between the tool driving apparatus and the upper portion of the integrated block, the spindle may be surrounded by nuts and/or a driving apparatus extension housing. The nuts and/or driving apparatus extension housing are stationary but allow for the rotation of the spindle within while protecting the spindle and the spindle's rotation from exterior elements. The length of the spindle continues through the upper portion of the integrated block and is connected to the cap node. The section of the spindle that extends through the upper portion of the integrated block is hollow. Upon emerging from the upper portion of the integrated block into the opening between the upper portion and lower portion of the integrated block, the bottom of the spindle is surrounded by a threaded bushing and a rotating washer that rotates with the spindle. Below the rotating washer is a non-rotating washer integral to the cap node. Within the non-rotating washer and cap node is a bearing housing that houses a bearing that is in contact with the spindle within the rotating bearing. This bearing is anything that allows for a small point of contact with the cap held by the cap node where the contact has downward non-rotating force, but does not impede the rotation of the assembly above it. In this way, the cap being forced downward is not damaged by the rotation of the spindle but benefits from the downward force of the rotation. The bearing may be a roller bearing, or a pointed or rounded piece that fits within the bearing housing, or any other piece capable of operating as described above. In this embodiment, the socket node does not included the threaded tube and threaded screw as described above, but is stationary in its position on the lower portion of the integrated block.

Although this embodiment has been described with reference to specific pieces, one of ordinary skill in the art that there are many ways to achieve the basic setup described herein, i.e. a setup that extends and transfers the rotation and downward force of a power tool, and each of these ways is contemplated as being within the scope of the present invention.

Although operable as described above, this preferred embodiment of the snap installation adaptor may also include a block support. The block support is preferably made of a strong, lightweight material, such as ABS plastic. The block support is attached to both the integrated block and the handheld tool, extending the length of the handheld tool with a space to allow for the user's hand to operate the trigger of the handheld tool. The block support preferably surrounds the driving apparatus extension between the tool driving apparatus and the upper portion of the integrated block and wraps around the end of the handheld tool.

The present invention also includes a kit, which includes, and is an integration of, the snap installation adaptor and the handheld tool as described above.

The present invention also includes a method for adapting a handheld power tool for use as a snap installation tool. The steps of the method include modifying a handheld power tool by removing apparatuses specific to the handheld power tool's original purpose, leaving only its tool driving apparatus; attaching a snap installation adaptor to the handheld power tool; placing a cap part in the cap node of the upper portion of the snap installation adaptor; placing a socket part in the socket node of the lower portion of the snap installation adaptor; placing a portion of a fabric where it is desirable to install a female or male snap portion in the opening of the snap installation adaptor between the cap and socket nodes; and pulling the trigger of the handheld power tool.

Therefore it is an aspect of the present invention to provide a snap installation adaptor that may be attached to a handheld power tool so that their integration is a snap installation tool.

It is a further aspect of the present invention to provide a handheld snap installation tool that is powered by something other than the human hand.

It is a further aspect of the present invention to save expense and materials by providing a snap installation adaptor that does not duplicate the complexity and expense of a handheld power tool, but merely attaches to an existing handheld power tool.

These aspects of the present invention are not meant to be exclusive and other features, aspects, and advantages of the present invention will be readily apparent to those of ordinary skill in the art when read in conjunction with the following description and accompanying drawings.

DETAILED DESCRIPTION

Figure 3A:
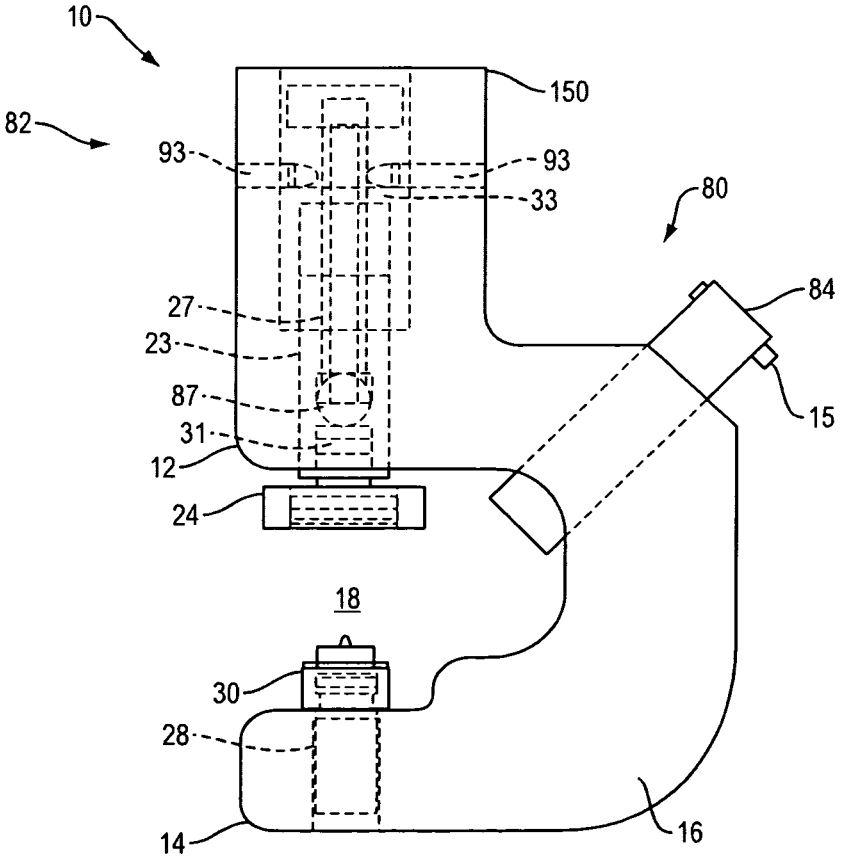
FIG. 3A is a side view of the preferred embodiment of the snap installation adaptor of the present invention.
Figure 3B:
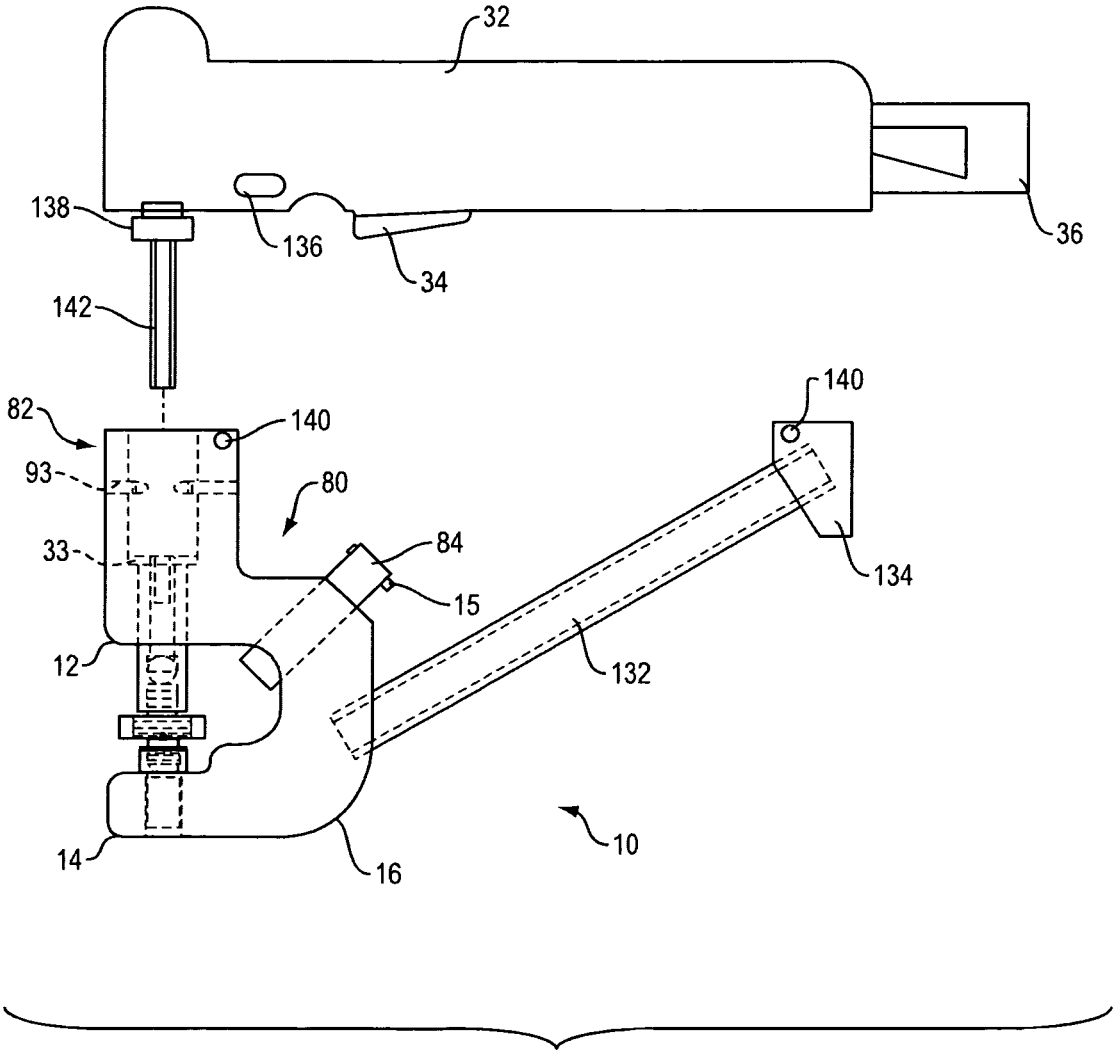
FIG. 3B is a side view of the preferred embodiment of the snap installation adaptor of the present invention and a handheld tool.

Referring first to FIG. 3A, the preferred snap installation adaptor 10 is shown. Snap installation adaptor 10 includes upper portion 12, lower portion 14, and intermediate portion 16. In this embodiment upper portion 12, lower portion 14, and intermediate portion 16 are combined into integrated block 80, which is approximately C-shaped. Upper portion 12 includes cap node 24. Lower portion includes socket node 30 and threaded screw 28 for adjusting the distance between cap node 24 and socket node 30. In this depiction, we see opening 18 between cap node 24 and socket node 30. Snap installation adaptor 10 also includes driving apparatus extension 82, which includes features for transmitting the force of handheld tool 32 (as shown in FIG. 3B, for example) through upper portion 12 and down onto lower portion 14 so as to affix snaps 46. Driving apparatus extension 82 is attached to and above upper portion 12, and is also integrated into integrated block 80. Driving apparatus extension 82 houses stop pins 93, screw shoulder 33, drive rod hole 27, threaded drive screw 23, ball 87, and o-ring lock 31. Driving apparatus extension 82 is a means for transferring the external downward force of handheld tool 32 through upper portion 12.

Stop pins 93 are located near top 150 of driving apparatus extension 82. Stop pins 93 stop screw shoulder 33 from extending any farther up through driving apparatus extension 82. Threaded drive screw 23 moves in concert with screw shoulder 33 and extends from screw shoulder 33 down to cap node 24 in upper portion 12. Threaded drive screw 23 houses drive rod hole 27, ball 87, and o-ring lock 31, so that all of these features, as well as cap node 24 move up and down together as pressure is applied from handheld tool 32 when snap installation adaptor 10 and handheld tool 32 are united. Drive rod hole 27 runs down through driving apparatus extension 82 toward upper portion 12, through threaded drive screw 23, and ends at ball 87. Drive rod hole 27 is sized and dimensioned to snugly surround drive rod 142, shown in FIG. 3B. Ball 87 is hard enough to withstand the repeated intense downward thrust and spin of drive rod 142 without undergoing significant degradation. Ball 87 is locked in place by o-ring lock 31, which is preferably made of rubber. Snap installation adaptor 10 shown in FIG. 3A also includes laser sight 84 with power switch 15. Laser sight 84 allows a user to see exactly where on a piece of fabric snap 46 will be installed.

Now referring to FIG. 3B, the elements of the kit of the present invention are shown, including handheld tool 32 and snap installation adaptor 10. Handheld tool 32 with trigger 34 is a 12 volt right angle impact driver with 700 in. lbs. torque sold under the trademark CRAFTSMAN. Handheld tool 32 also includes forward-reverse button 136 and battery 36, which is in this case a 12 volt lithium ion battery. Drive rod 142 is removable attached to handheld tool 32 at collet 138. Drive rod 142 is preferably ¼" and hexagonal. Drive rod hole 27, discussed above, is therefore preferably sized and dimensioned to accept a ¼" hexagonal drive rod 142. Additionally, collet 138 is also preferably hexagonal. Collet 138 is also preferably a quick-change type collet. When handheld tool 32 and snap installation adaptor 10 are united, drive rod 142 will drive down and twist into driving apparatus extension 82, through drive rod hole 27 within threaded drive screw 23 until it contacts ball 87. This will cause threaded drive screw 23, which is in contact with cap node 24 to move downward to meet socket node 30 and permanently affix both sides of snap 46 to either side of a piece of fabric.

Figure 1A:
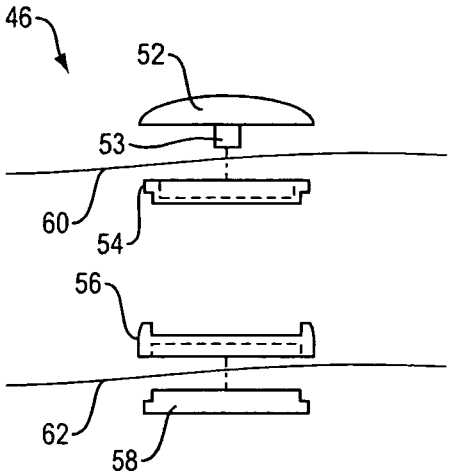
FIG. 1A (PRIOR ART)
FIG. 1A is a prior art illustration of the components of a snap where it is desirable to snap a fabric to a hard surface.
Figure 1B:
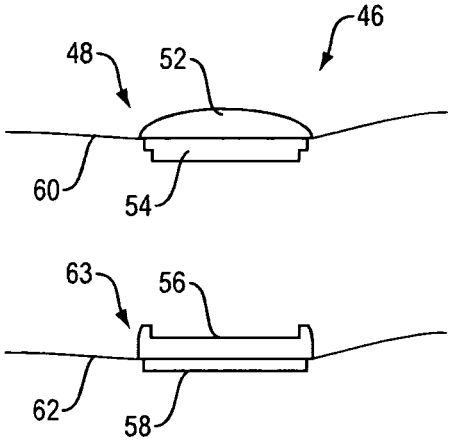
FIG. 1B (PRIOR ART)
FIG. 1B is a prior art illustration of the components of a snap where it is desirable to snap a fabric to another fabric.
Figure 1C:
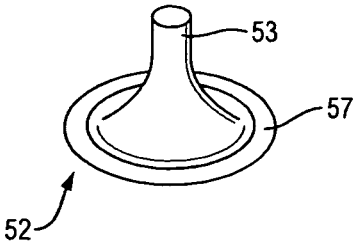
FIG. 1C is a perspective view of a prior art female cap portion of a snap.
Figure 1D:
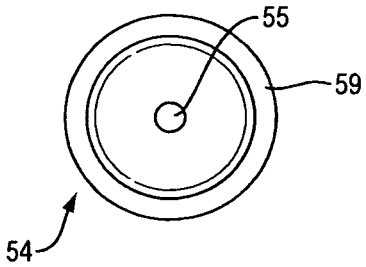
FIG. 1D is a top down view of a prior art female socket portion of a snap.
Figure 2:
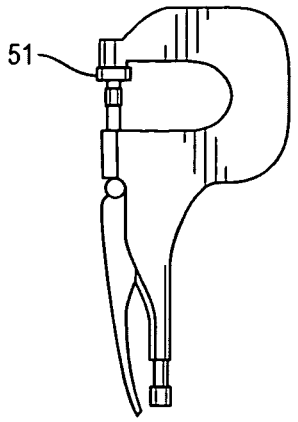
FIG. 2 (PRIOR ART)
FIG. 2 is an illustration of a prior art snap installation tool.

If the user wishes to install integrated female portion 48 of snap 46 to fabric 60 (as shown in FIGS. 1A and 1B), then the user will position female cap 52 in cap node 24 and female socket 54 in socket node 30. If the user wishes to install integrated male portion 63 of snap 46 to fabric 62, then the user will position male socket 58 in cap node 24 and male cap 56 in socket node 30. As discussed above with reference to FIGS. 1A and 1B, it is more likely that a user will install integrated female portion 48 than integrated male portion 63, as male cap 52 is often installed on a hard surface to which fabric 60 including integrated female portion 48 is to be snapped. In such instances, male cap 52 is affixed to the hard surface and snap 46 does not include male socket 58. In some situations, however, it is desirable for two fabrics 60, 62 to be snapped together in which case, fabric 60 will include integrated female portion 48, with female cap 52 and female socket 54 on either side of fabric 60, and fabric 62 will include integrated male portion 63, with male cap 56 and male socket 58 on either side of fabric 62.

In FIG. 3A, opening 18 occurred between cap node 24 and socket node 30. In FIG. 3B, they are shown in contact, as they would be had drive rod 142 extended downward as described above. When this happens, screw shoulder 33 moves downward with threaded drive screw 23 and is no longer in contact with and stopped by stop pins 93.

The embodiment of snap installation adaptor 10 shown in FIG. 3B includes support rod 132, which provides support between snap installation adaptor 10 and handheld tool 32 when they are united. Support rod 132 is preferably made of plastic tubing that is approximately 6.75" long and has an inner diameter of approximately ½". Support rod 132 includes support rod end cap 134, including pin 140 for attaching support rod 134 to handheld tool 32. Driving apparatus extension 82 also includes pin 140 for attachment to handheld tool 32. Pins 140 are preferably quick lock-type pins, meaning they include a spring-loaded ball bearing that is triggered by a cleaver push-button mechanism.

Figure 3C:
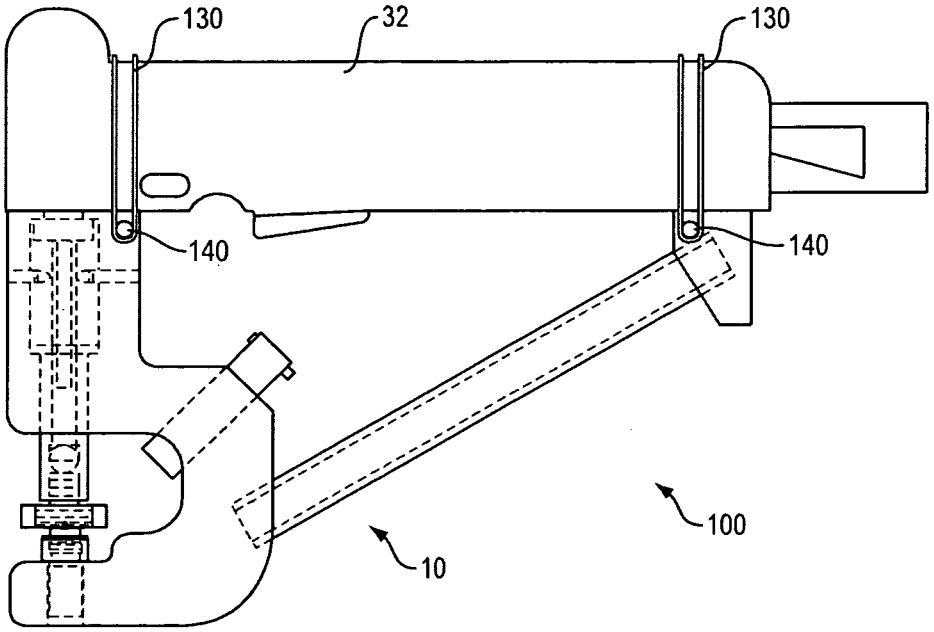
FIG. 3C is a side view of the preferred integrated snap installation tool of the present invention.

Now referring to FIG. 3C, snap installation tool 100, consisting of the united handheld tool 32 and snap installation adaptor 10 is shown. Handheld tool 32 and snap installation adaptor 10 are attached by pins 140, discussed above, and removable bands 130. Removable bands 130 are removable to separate handheld tool 32 and snap installation adaptor 10 as necessary. Removable bands 130 are preferably quick lock-type bands and made of rubber.

Figure 9:
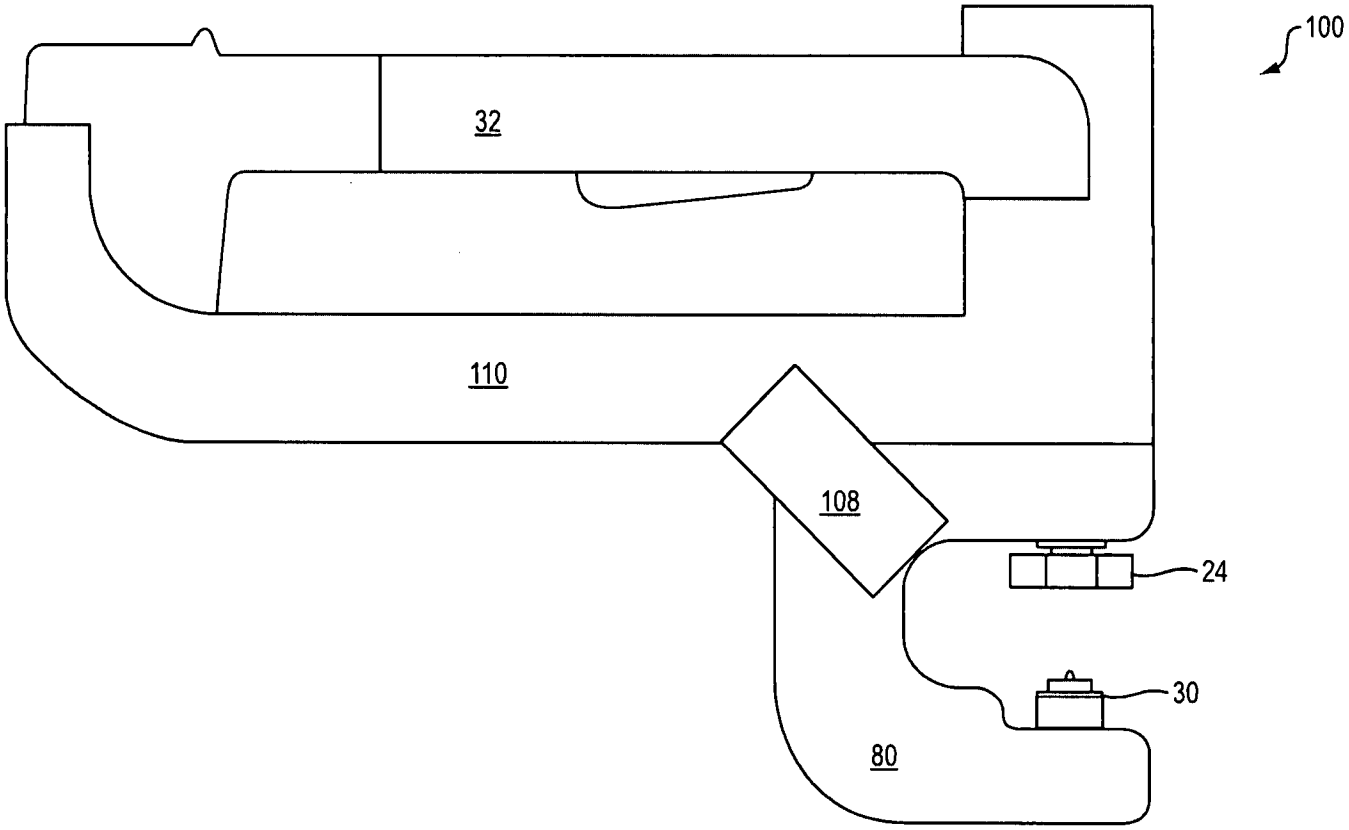
FIG. 9 is a side view of the preferred integrated snap installation tool of the present invention with a block support.

Now referring to FIG. 9, a similar embodiment to that shown in FIG. 3C is shown with block support 110, rather than support rod 134. The depiction in FIG. 9 shows snap installation tool 100 from the other side from that shown in FIG. 3C. Laser sight 84 is housed within laser sight cover 108. Block support 110 extends the length of handheld tool 32 and wraps around the end of handheld tool 32 that includes driving location 42. Block support 110 also covers driving apparatus extension 82 above upper portion 12 of integrated block 80. Although not visible, it is understood that driving apparatus extension 82 operates as described above. Block support 110 may take other shapes than that depicted in FIG. 9. Block support 110 may also be included with the alternative embodiment shown in FIG. 10 and discussed below.

Figure 10:
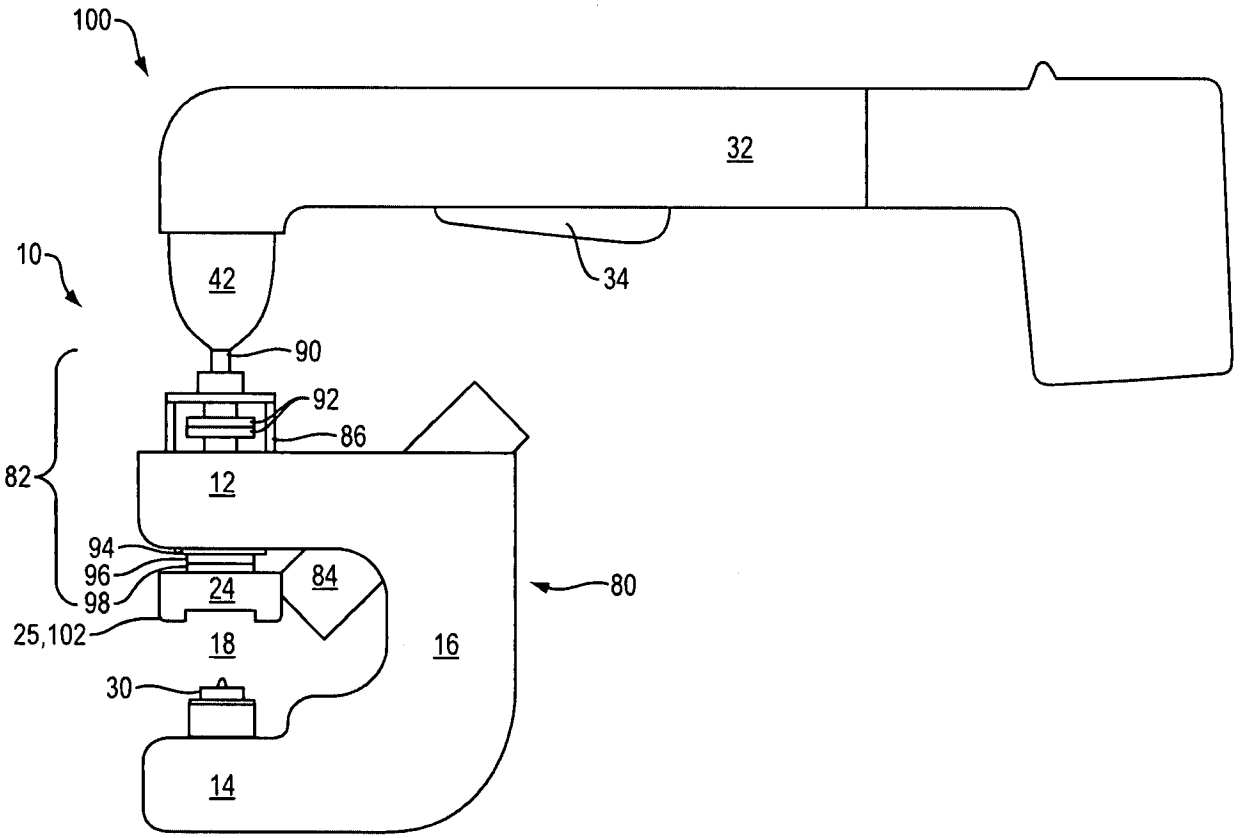
FIG. 10 is a side view of an alternative embodiment of the preferred snap installation adaptor of the present invention.
Figure 11:
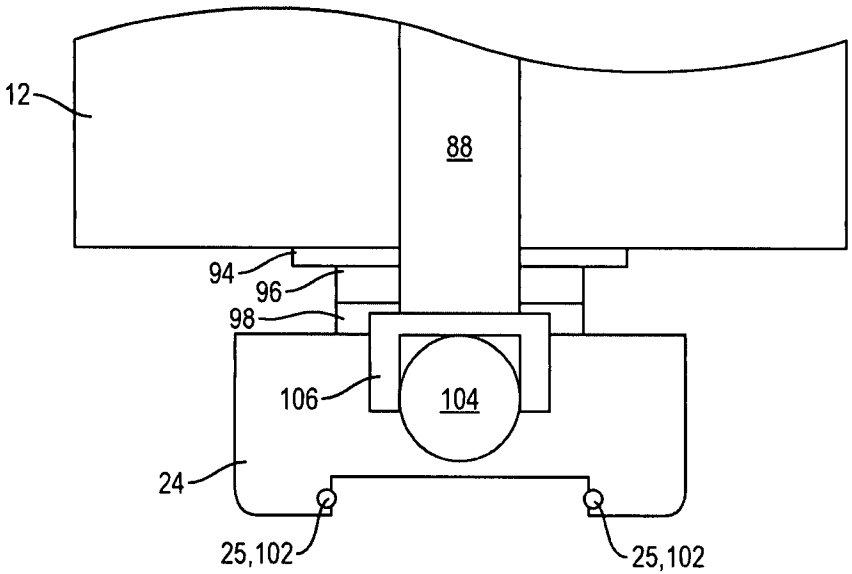
FIG. 11 is an exploded side cutaway diagram of the setup below the upper portion of the snap installation tool shown in FIG. 10.

Now referring to FIGS. 10 and 11, an alternative embodiment of the preferred snap installation tool 100 is shown. Again, handheld tool 32 with trigger 34 is a right angle impact driver sold under the trademark CRAFTSMAN. Driving apparatus extension 82 connects tool driving apparatus 40, which is understood to be housed within driving location 42, and integrated block 80. Integrated block 80 is a single piece including upper portion 12, lower portion 14, and intermediate portion 16 of snap installation adaptor 10. Driving apparatus extension 82 includes hex driving bit 90, spindle 88, nuts 92, driving apparatus extension housing 86, threaded bushing 94, rotating washer 96, non-rotating washer 98, and bearing 104, and bearing housing 106. Driving apparatus extension 82 passes through upper portion 12 of integrated block 80 via spindle 88. FIG. 10 shows the generally "C" shaped structure of integrated block 80. Laser sight 84 is attached to the far side of integrated block 80 from the viewer's standpoint. In this embodiment, the placement device 25 within cap node 24 is o-ring 102, best shown in FIG. 11. Socket node 30 is stationary and integral to lower portion 14 of integrated block 80.

Driving apparatus extension 82 is directly connected to tool driving apparatus 40 by hex driving bit 90, which surrounds spindle 88. Driving apparatus extension 82 is a means for transferring the external downward force of handheld tool 32 through upper portion 12. This allows the rotating action of tool driving apparatus 40 to be extended beyond handheld tool 32. Between tool driving apparatus 40 and upper portion 12 of integrated block 80, spindle 88 is surrounded directly by nuts 92 and by driving apparatus extension housing 86, although there is space between driving apparatus extension housing 86 and nuts 92 surrounding spindle 88. The length of spindle 88 continues through upper portion 12 of integrated block 80 and is in mechanical contact with cap node 24. Spindle 88 is hollow through upper portion 12, which is best depicted in FIG. 11. Upon emerging from upper portion 12 into opening 18 between upper portion 12 and lower portion 14 of integrated block 80, the bottom of spindle 88 is surrounded by threaded bushing 94 and rotating washer 96 that rotates with spindle 88. Below rotating washer 96 is non-rotating washer 98 integral to cap node 24. As shown in FIG. 11, within non-rotating washer 98 and cap node 24 is bearing housing 106 that houses bearing 104 that is in contact with spindle 88 within rotating bearing 96. Although bearing 104 is depicted in FIG. 11 as a roller bearing, it is understood that bearing 104 is anything that allows for a small point of contact with the cap held by cap node 24 where the contact has downward non-rotating force, but does not impede the rotation of the assembly above it, and that bearing 104 may take many shapes.

Figure 4A:
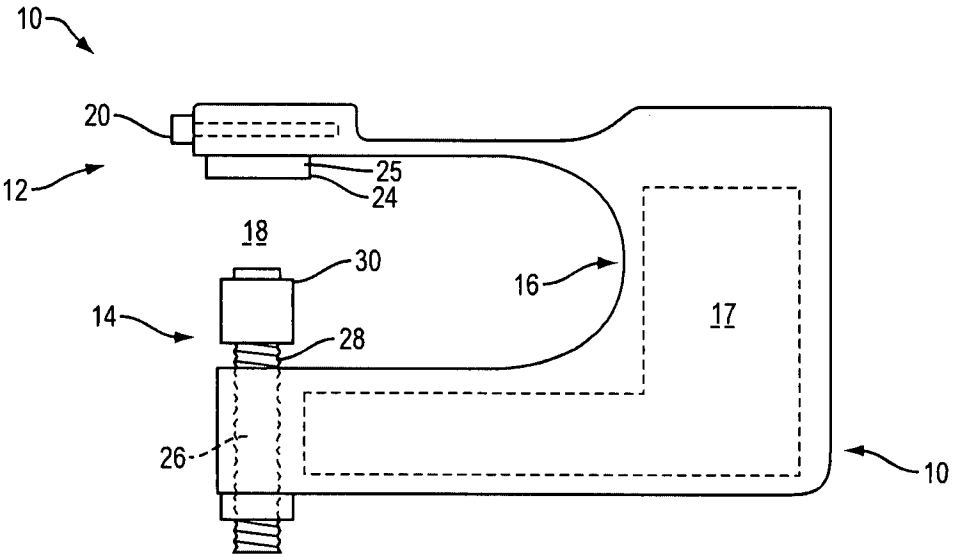
FIG. 4A is a side view of an alternative snap installation adaptor of the present invention.
Figure 4B:
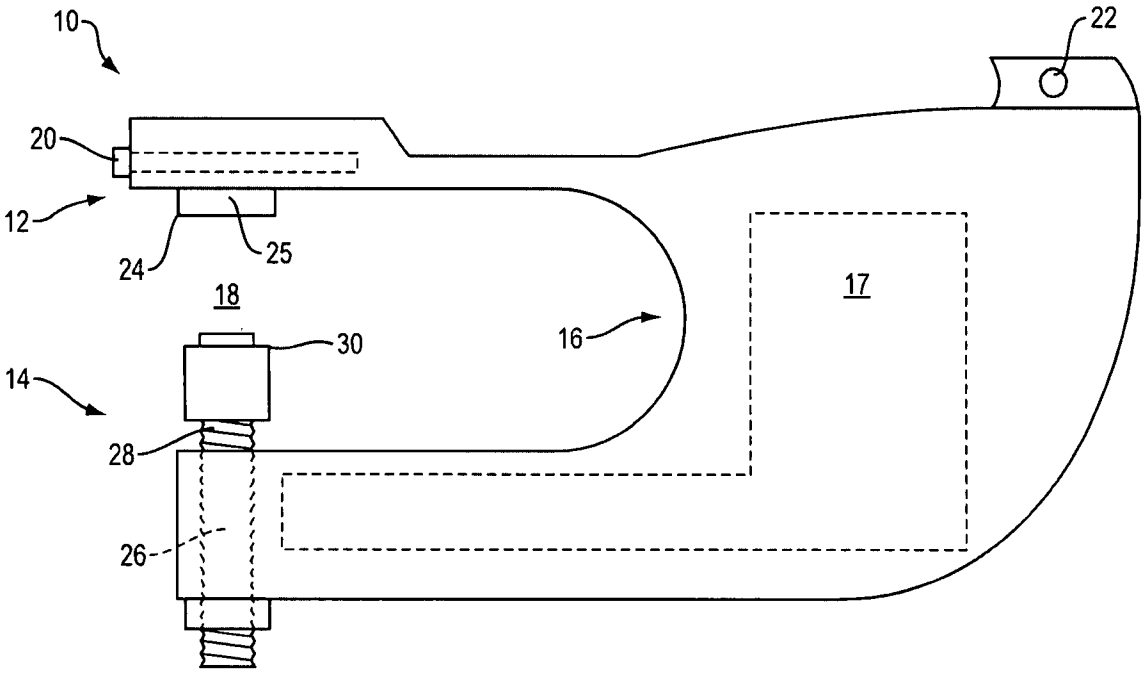
FIG. 4B is a side view of another alternative snap installation adaptor of the present invention.
Figure 5A:
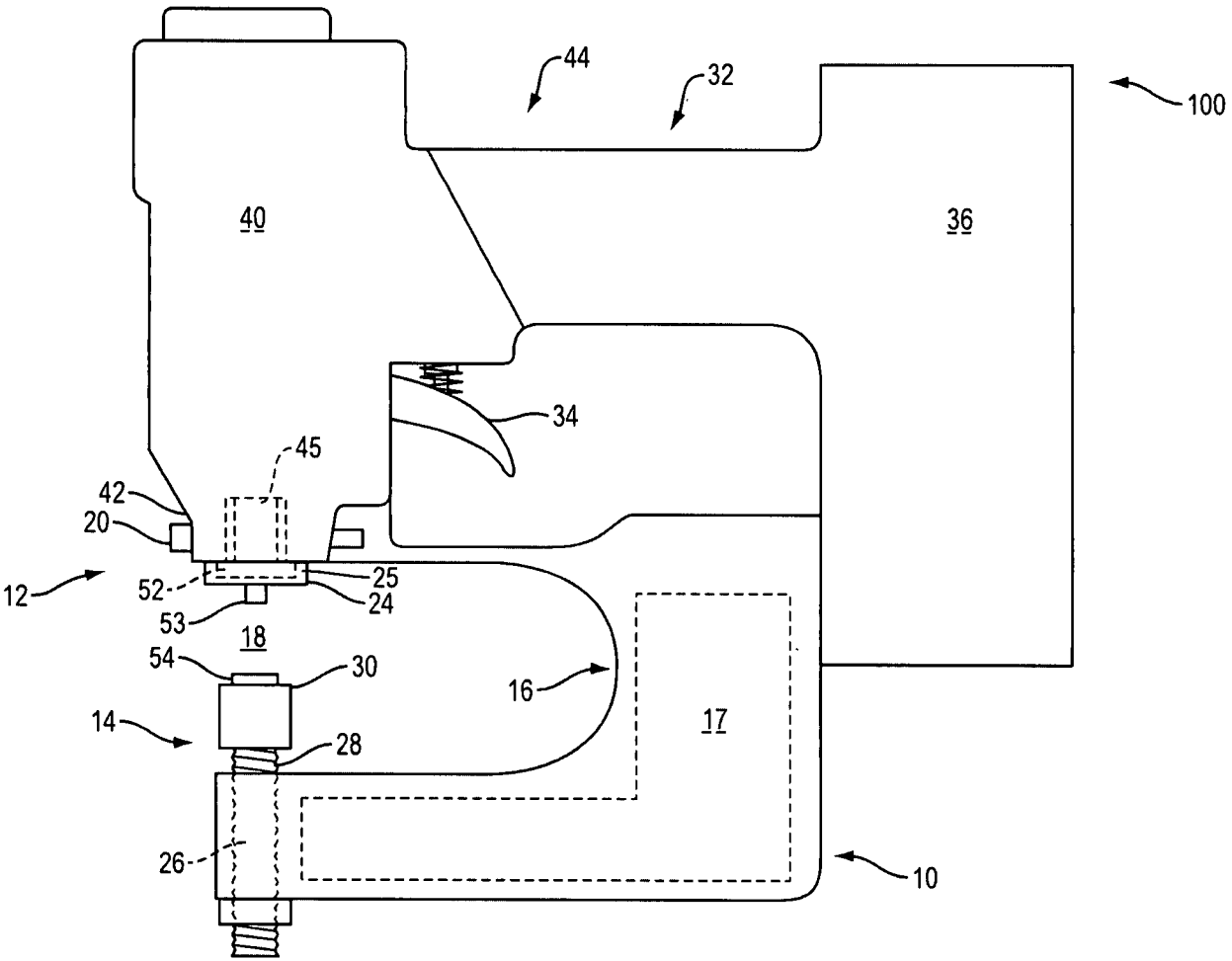
FIG. 5A is a side view of a snap installation tool of the present invention using the snap installation adaptor as shown in FIG. 4A.
Figure 5B:
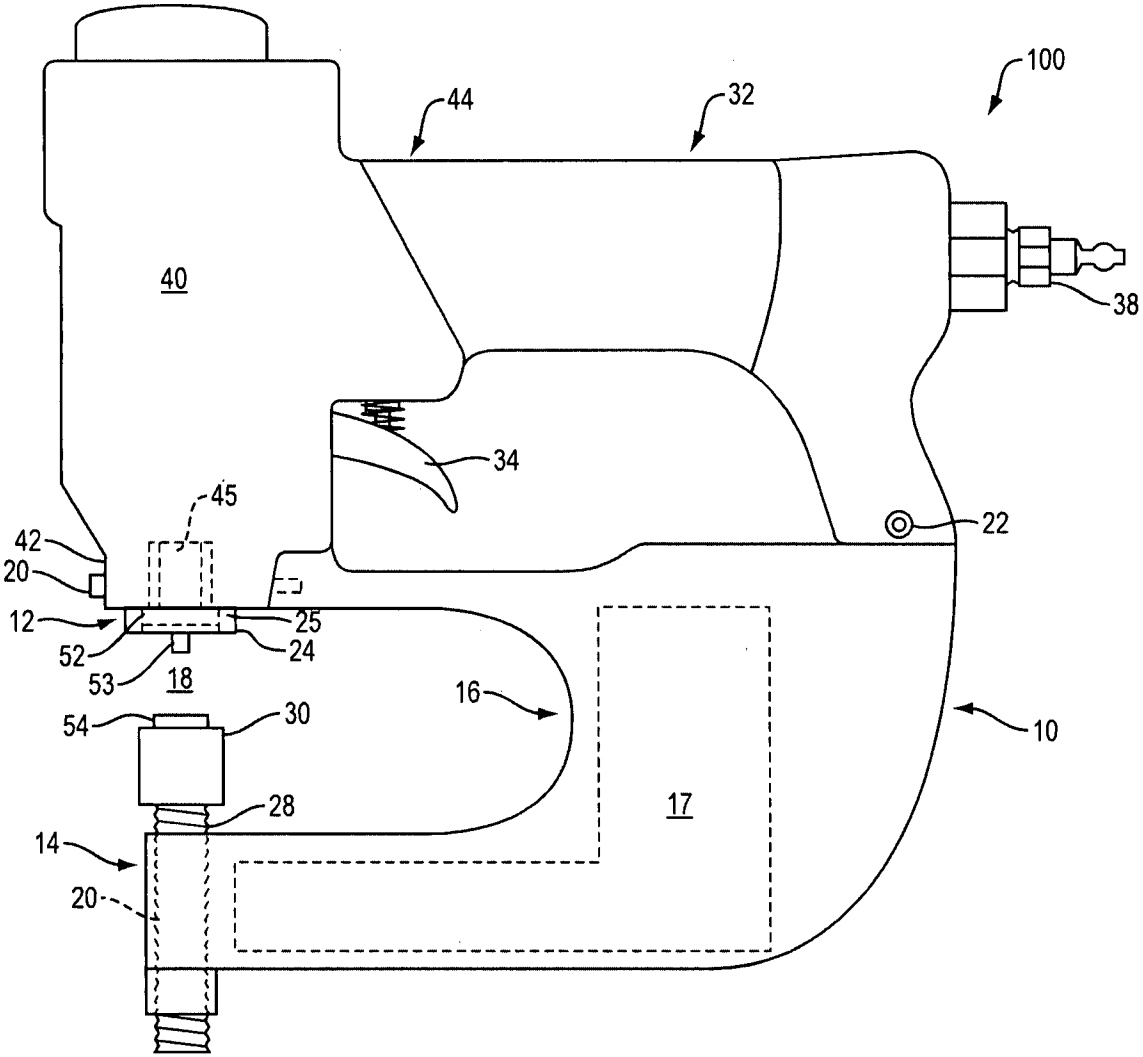
FIG. 5B is a side view of a snap installation tool of the present invention using the snap installation adaptor as shown in FIG. 4B.

Now referring to FIGS. 4A and 4B two alternative embodiments of the snap installation adaptor 10 of the present invention are shown. Snap installation adaptor 10 as shown in FIG. 4A is adapted to attach to a battery operated handheld tool, as shown in FIG. 5A. Snap installation adaptor 10 as shown in FIG. 4B is adapted to attach to a pneumatic operated handheld tool, as shown in FIG. 5B. Snap installation adaptor 10 is preferably made of reinforced plastic for low cost and weight, but may also be made of cast aluminum or other materials. Snap installation adaptor 10 includes an upper portion 12, a lower portion 14, and an intermediate portion 16 that includes reinforcement 17. Upper portion 12 and lower portion 14 form an opening 18 therebetween.

Upper portion 12 includes attachment screw 20 and cap node 24. Upper portion 12 is designed to attach to a handheld tool 32 through attachment screw 20. Attachment screw 20 is preferably threaded and runs through upper portion 12 as shown in dashed lines. Handheld tool 32 includes a corresponding threaded hole (not shown) designed to accept attachment screw 20. Although a threaded attachment screw 20 is the preferred device for joining the handheld tool 32 and the snap installation adaptor 10, other art recognized attachment devices may be substituted in other embodiments. In addition, in some embodiments, such as that shown in FIG. 4B, an additional attachment screw 22 may be included to further stabilize the attachment of handheld tool 32 and snap installation adaptor 10. In FIG. 4B, additional attachment screw 22 is shown on intermediate portion 16 of snap installation adaptor 10, but it is understood that additional attachment screw 22 may be positioned in several different locations on snap installation adaptor 10 depending on what would work best with various handheld tools 32.

Upper portion 12 also includes cap node 24, where female cap 52 or male cap 56 (as shown in FIGS. 1A and 1B) may be held for installation. In practice, the tool driving apparatus 40 of a handheld tool 32 (shown in FIGS. 3C and 6-11) to which snap installation adaptor 10 is attached will drive the cap part, held by cap node 24, down onto a fabric placed in opening 18 between the cap part and a socket part held by lower portion 14 of snap installation adaptor 10 so that the snap portion may be installed on the fabric. Cap node 24 includes placement device 25 for properly placing female cap 52 within cap node 24 prior to snap installation so that female cap 52 in cap node 24 will be properly aligned with female socket 54 in socket node 30 in lower portion 14 of snap installation adaptor 10, as discussed below. Placement device 25 may be a weakly spring loaded device that will hold female cap 52 in alignment with socket node 30 prior to snap installation, but will not hold it so firmly that it does not easily release upon installation. Placement device 25 may be a device including a ball bearing or a magnet so as to hold female cap 52 in place.

Lower portion 14 is positioned directly opposite from upper portion 12 and includes a threaded tube 26, a threaded screw 28, and a socket node 30. Threaded tube 26 is depicted in FIGS. 4A and 4B to show its position within lower portion 14, but it is understood that threaded tube 26 is not actually visible through lower portion 14 unless lower portion 14 happens to be made of transparent or translucent material. Threaded tube 26 extends through lower portion 14 and is adapted to accept threaded screw 28. Threaded screw 28 is positioned through threaded tube 26 so that the length of threaded screw 28 within and outside of threaded tube 26 may be adjusted so that more or less of threaded screw 28 may extend into opening 18 between upper and lower portions 12, 14 of snap installation adaptor 10. The end of threaded screw 28 that extends into opening 18 includes socket node 30 where female socket 54 or male socket 58 may be held for installation. Threaded screw 28 and threaded tube 26 are so positioned within lower portion 14 that when threaded screw 28 is extended to its extreme through opening 18, socket node 30 of lower portion 14 and cap node 24 of upper portion 12 will meet.

Intermediate portion 16 may include reinforcement 17, shown in dotted lines in FIGS. 4A and 4B. Reinforcement 17 is preferably an L-shaped bracket that is attached to or integral to intermediate portion 16 so that snap installation adaptor 10 may better withstand the force that will be applied upon it when it is united with a handheld tool 32. Reinforcement 17 is usually used in the preferred embodiment when snap installation adaptor 10 is made of plastic, but may also be used when snap installation adaptor 10 is made of other materials. In preferred embodiments, however, intermediate portion 16 is made of a material strong enough so that it does not require reinforcement 17.

Now referring to FIGS. 5A and 5B, two embodiments of snap installation tool 100, which is the assembled kit of the present invention, are shown. Snap installation tool 100 includes the integration of a handheld tool 32 and a snap installation adaptor 10 of the present invention, as described above. FIG. 5A depicts a snap installation tool 100 that is battery operated, i.e. the handheld tool that was modified to make handheld tool 32 is battery operated. FIG. 5B depicts a snap installation tool 100 that is pneumatic operated, i.e. the handheld tool that was modified to make handheld tool 32 is pneumatic operated. Handheld tool 32 includes trigger 34, battery 36 or pneumatic connector 38, tool driving apparatus 40, and driving location 42.

FIGS. 5A and 5B show female cap 52 held in place in cap node 24 by placement device 25 in alignment with female socket 54 in place in socket node 30 prior to snap installation.

Snap installation adaptor 10 and handheld tool 32 are attached at attachment screw 20. As mentioned above, with reference to FIGS. 4A and 4B, handheld tool 32 includes a corresponding threaded hole (not shown, but corresponding to the dotted lines showing the location of attachment screw 20 within upper portion 12 of snap installation adaptor 10, shown in FIGS. 4A and 4B) designed to accept attachment screw 20 of snap installation adaptor 10. The corresponding threaded hole runs through driving location 42 of the handheld tool 32. Driving location 42 is the section of snap installation tool 100 where the driving force of the tool will occur. Specifically driving location 42 is where upper portion 12 of snap installation adaptor 10 combines with tool driving apparatus 40 of handheld tool 32. The corresponding threaded hole is positioned through driving location 42 such that handheld tool 32 and snap installation adaptor 10 are securely attached to one another when attachment screw 20 is engaged, but the tool driving apparatus 40, particularly the tool driving apparatus 40 at the driving location 42, is not encumbered by the corresponding threaded hole or attachment screw 20 when engaged, and the handheld tool 32 and snap installation adaptor 10 are able to work in concert as snap installation tool 100. This set up is a means for transferring the external downward force of handheld tool 32 through the upper portion 12. As shown in FIG. 5B, some embodiments of the present invention include additional attachment screw 22 shown attaching intermediate portion 16 of snap installation adaptor 10 with the other side of handheld tool 32.

Additional attachment screw 22 will be used when the size and/or dimension of handheld tool 32 make this additional site of attachment advisable or necessary.

The modifications to a handheld tool to make it handheld tool 32 are illustrated in FIGS. 5A and 5B. Handheld tool 32 includes the body 44 of a handheld tool, trigger 34, power means, such as battery 36 in FIG. 5A and pneumatic connector 38 in FIG. 5B, tool driving apparatus 40, including piston 45, that may drive through driving location 42, and a corresponding threaded hole formed through driving location 42, as described above. The main modification of the handheld tool to make handheld tool 32 is the removal of apparatuses specific to the original function of the handheld tool. If the handheld tool were a nail gun, for example, the nail carriage would be removed from the handheld tool, but the tool driving apparatus 40 that drove the nails remains in handheld tool 32 so that it may drive the snap installation function when handheld tool 32 is integrated with snap installation adaptor 10. Tool driving apparatus 40 is not entirely shown in FIGS. 4A and 4B, but is understood to exist within body 44 of handheld tool 32. Piston 45 is depicted in dotted lines at driving location 42 to demonstrate its existence and function as a force upon the components of upper portion 12 of snap installation adaptor 12, but it is understood that piston 45 is not actually visible through driving location 42. This set up is a means for transferring the external downward force of handheld tool 32 through the upper portion 12.

Figure 6:
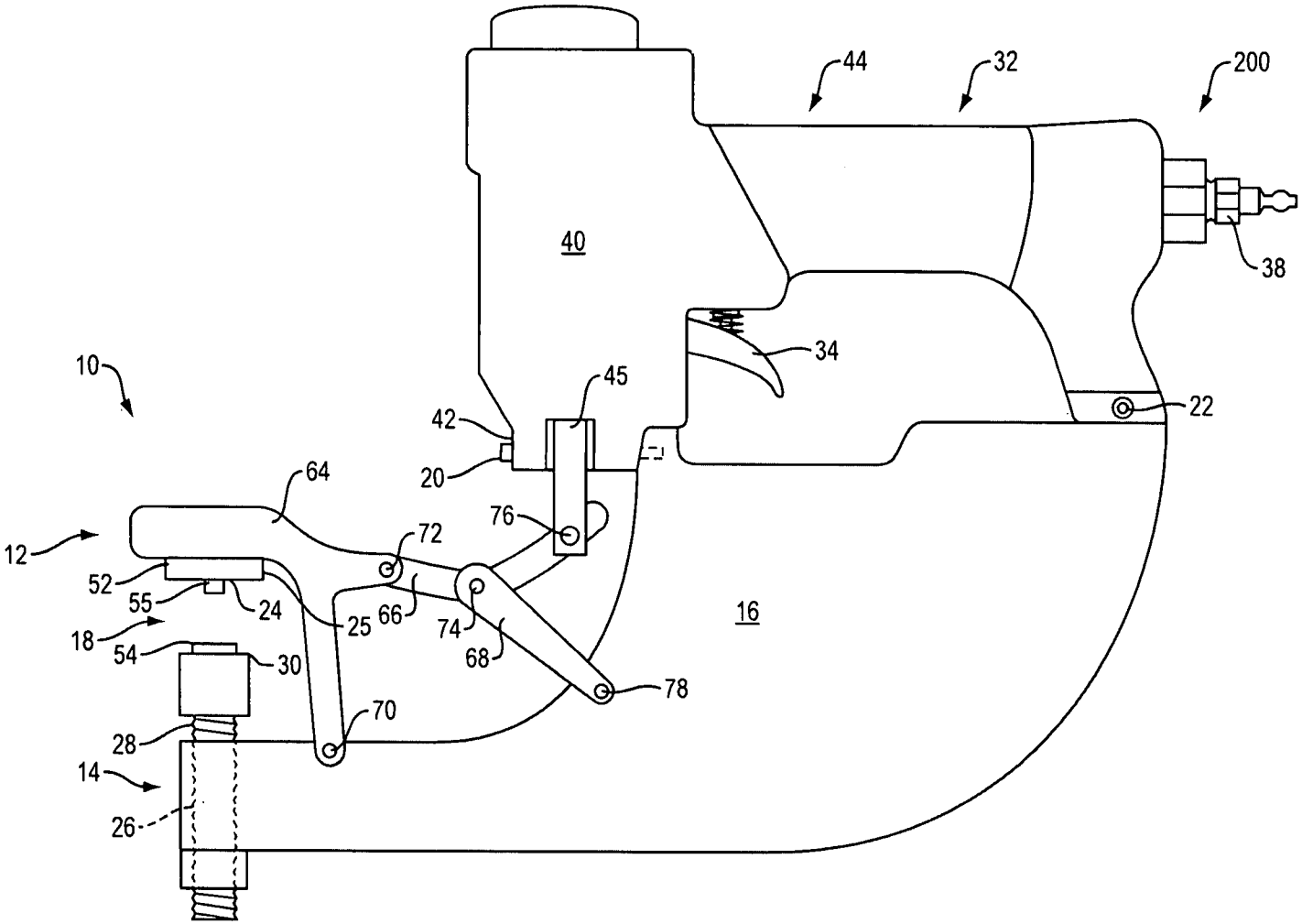
FIG. 6 is a side view of an alternate embodiment of the snap installation tool of the present invention as shown in FIG. 5B.

Referring now to FIG. 6, snap installation tool 200 is shown. Snap installation tool 200 is an alternate embodiment of snap installation tool 100 as shown in FIG. 5B. Snap installation tool 200 includes the same modified hand tool 32 as shown in FIG. 5B. Snap installation adaptor 10, however, is different. Intermediate portion 16 is more substantial in FIG. 6, and lower portion 14 extends out beyond the physical dimensions of modified hand tool 32 so that lower portion 14 is not directly beneath tool driving apparatus 40, as in FIG. 5B. Snap installation tool 200 also includes arms 64, 66, 68 and swivels 70, 72, 74, 76, 78. Arms 64, 66, 68 are preferably made of a rigid metal or plastic. Swivels 70, 72, 74, 76, 78 are preferably metal or plastic screws or pins capable of extending through more than one layer of plastic or metal, such as an arm 64, 66, 68, so that the layers are held securely together but may move independently in relation to one another. Arm 64 is connected to lower portion 14 at swivel 70 and to arm 66 at swivel 72. Arm 66 is connected to arm 68 at swivel 74 and to piston 45 at swivel 76. Arm 68 is connected to arm 66 at swivel 74 and to intermediate portion 16 at swivel 78. Arms 64, 66, 68 and swivels 71, 72, 74, 76, 78 work together and move in concert such that the motion and force of piston 45 is transferred to upper portion 12 so that a snap may be installed. Arms 64, 66, 68 and swivels 71, 72, 74, 76, 78 are a means for transferring the external downward force of handheld tool 32 through the upper portion 12.

Figure 7:
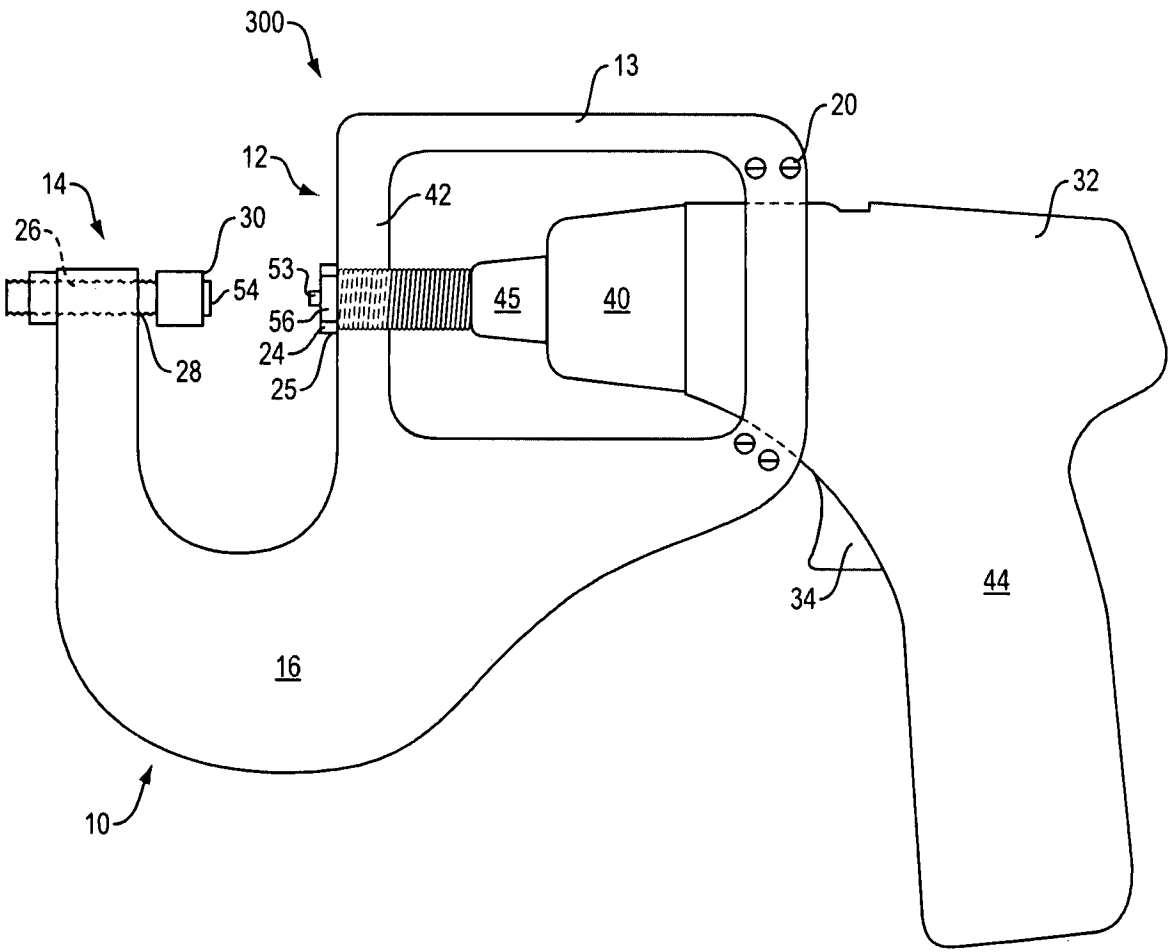
FIG. 7 is a side view of a preferred embodiment of the snap installation tool of the present invention.

Now referring to FIG. 7, snap installation tool 300 is shown. Snap installation tool 300 preferably includes a modified hand tool 32 that is a cordless drill sold under the trademark BOSCH. Snap installation adaptor 10 of snap installation tool 300 is secured to modified hand tool 32 by attachment screws 20 on body 44 of modified hand tool 32. Snap installation adaptor 10 also includes reinforcement loop 13 extending from upper portion 12. Reinforcement loop 13 provides an additional site of contact between snap installation adaptor 10 and modified hand tool 32 where attachment screws may be placed as shown.

Figure 8:
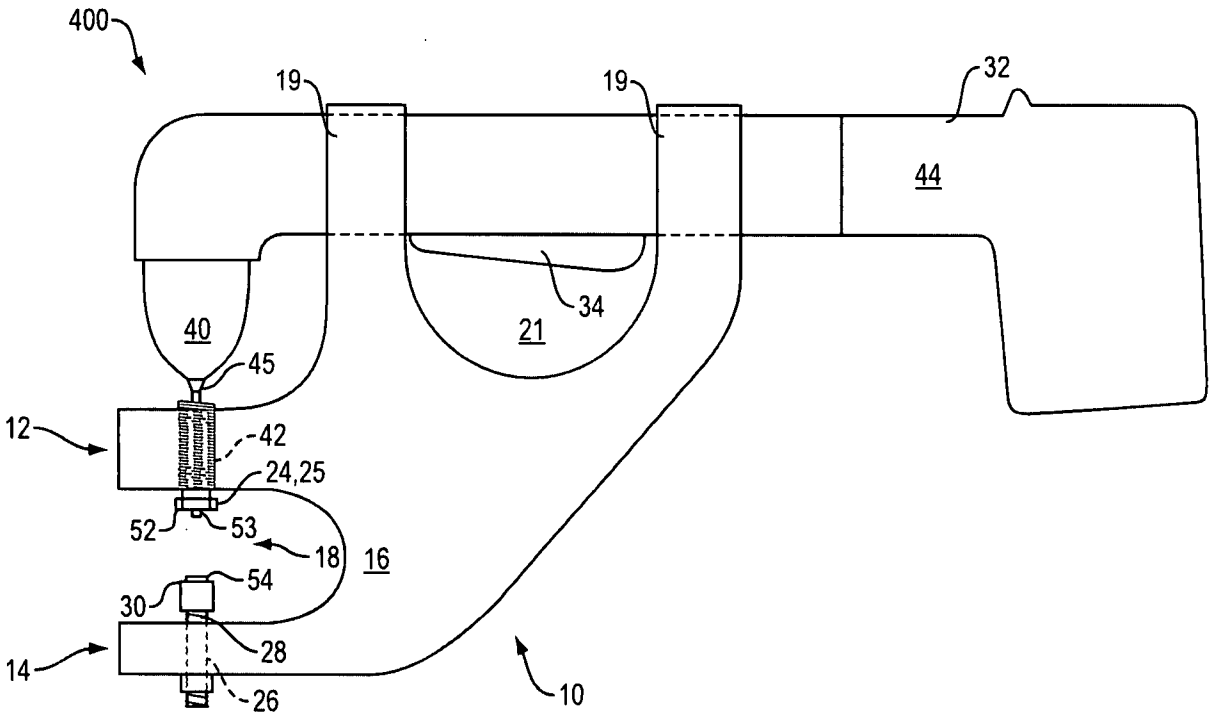
FIG. 8 is a side view of a preferred embodiment of the snap installation tool of the present invention.

Now referring to FIG. 8, snap installation tool 400 is shown. Snap installation tool 400 preferably includes a modified hand tool 32 that is a 90 degree cordless drill sold under the trademark DEWALT. In snap installation tool 400, snap installation adaptor 10 attaches to modified hand tool 32 at sites 19 and the shape of snap installation adaptor 10 is adapted for this purpose. The shape of snap installation adaptor 10 and the attachment at sites 19 allows for hand space 21 near trigger 34.

Snap installation tools 200, 300, and 400 as shown in FIGS. 6-8 may all be cordless, electric, or pneumatic.

Figure 12B:
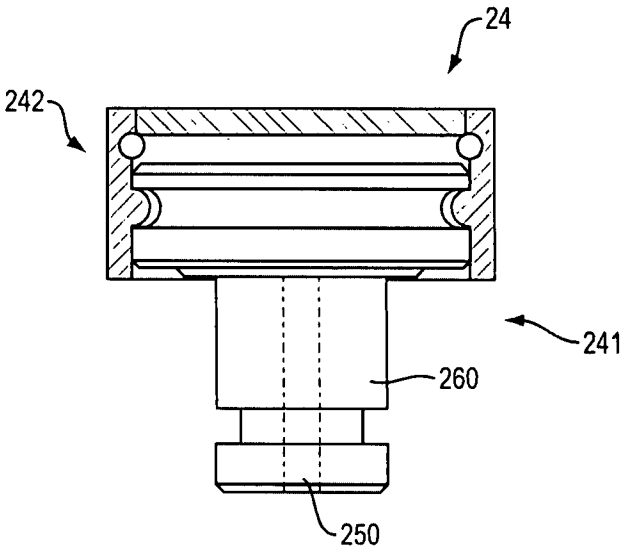
FIG. 12B is a section view of the assembled improved cap node of FIG. 12A.
Figure 12A:
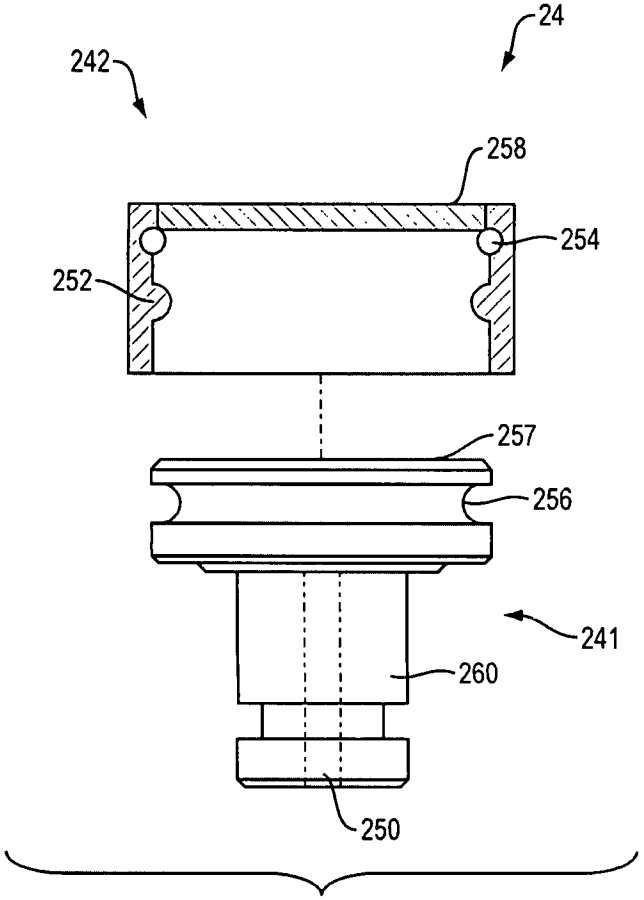
FIG. 12A is an exploded section view of the improved cap node of the present invention.

Referring now to FIG. 12A, an exploded section view of the improved cap node 24 of the present invention is shown. Cap node 24 includes metal base 241 and cap holder 242. The metal base 241 includes a stem 260 and a round top portion 257 that includes a female detent 265 disposed about the perimeter of the top portion 257. The metal base 241 is identical in all respects to the base used in prior art snap installation tools with the exception of the inclusion of a hardened rod 250 that is inserted within the stem 260 of the metal base 241 to prevent wear caused by the ball 87 of the preferred embodiment of the present invention. However, the hardened rod 250 may be omitted in embodiments of the cap node 241 that will be used to replace the prior art cap node on existing snap installation tools.

The cap holder 242 is preferably manufactured of plastic and includes an open top 258 and a male detent 252 that mates with the female detent 256 of the metal base 241. An O-ring 254 is disposed in a groove proximate the top 258 of the cap holder 242 and is dimensioned to deform when a cap, such as cap 52 of FIG. 1A, is pushed through the open top 258 and to hold the cap in place against the top portion 257 of the metal base 241.

The assembled cap node 24 is shown in FIG. 12B. The cap holder 242 is pressed onto the metal base 241 and is permanently affixed thereto by the mating of detents 252, 256. The O-ring 254 is disposed above the top of the top portion 257 of the metal base to provide a space sufficient for the cap to fit and be held in contact with the top.

It is noted that the present invention may be adapted to install other two part items, such as grommets or the like, by simply modifying the cap node 24 and socket node 30 and the present invention should not be seen as being limited to the installation of snaps.

Although the present invention has been described in considerable detail with reference to certain preferred versions thereof, other versions would be readily apparent to those of ordinary skill in the art. Therefore, the spirit and scope of the description should not be limited to the description of the preferred versions contained herein.

We claim:

1. A snap installation adaptor designed to be united with a handheld tool comprising a trigger that controls an automatic execution of an exertion of strong downward force, wherein the union is capable of permanently affixing snaps onto fabric, said snap installation adaptor comprising:

an upper portion comprising a cap node sized, shaped, and dimensioned to hold one of a group consisting of a female cap, a male cap, or a male socket of the snap;

a lower portion comprising a socket node sized, shaped, and dimensioned to hold one of a group consisting of a female socket, a male cap, or a male socket of the snap;

an intermediate portion connecting said upper portion and said lower portion;

means for transferring external downward force from the handheld tool is able to be transferred through said upper portion such that said cap node of said upper portion is forced to meet said socket node of said lower portion; and means for attaching said snap installation adaptor and the handheld tool such that the automated strong downward force of the handheld tool is able to be transferred through said upper portion of said snap installation adaptor such that said cap node of said upper portion is forced to meet said socket node of said lower portion;

wherein said upper portion, said lower portion, and said intermediate portion are integrated into an integrated block and said integrated block further comprises a driving apparatus extension above said upper portion, wherein said driving apparatus extension houses said means for transferring external downward force and wherein said driving apparatus extension comprises a top;

wherein said means for transferring external downward force comprises a threaded drive screw in communication with said cap node of said upper portion and capable of moving within and through said driving apparatus extension and said upper portion such that when no external downward force is applied, said threaded drive screw is housed entirely within said driving apparatus extension and said upper portion, and when external downward force is applied, said threaded drive screw extends below said upper portion causing said cap node to be in contact with said socket node of said lower portion.

2. The snap installation adaptor as claimed in claim 1, wherein said driving apparatus extension further comprises stop pins and a ball, and said threaded drive screw comprises a screw shoulder, wherein:

said stop pins are proximate to said top of said driving apparatus extension and are positioned such that said stop pins stop said screw shoulder of said threaded drive screw from extending through said top of said driving apparatus extension; and said ball is positioned between said threaded drive screw and said upper portion such that when external downward force is applied, it is applied through said threaded drive screw and down onto said ball.

3. The snap installation adaptor as claimed in claim 1, further comprising a laser sight positioned so as to provide a visible laser beam between said upper portion and said lower portion that indicates on the fabric placed between said upper portion and said lower portion where the snap will be permanently affixed.

4. The snap installation adaptor as claimed in claim 1, wherein said lower portion comprises a threaded screw for adjusting a distance between said socket node of said lower portion and said cap node of said upper portion.

5. The snap installation adaptor as claimed in claim 1, wherein said upper portion comprises a placement device for holding one of a group consisting of a female cap, a male cap, and a male socket snap part of the snap in place within said cap node such that said one of said group is easily released upon the permanent affixation of said one of said group to the fabric.

6. The snap installation adaptor as claimed in claim 1, further comprising a support for supporting the union of said snap installation adaptor and the handheld tool.

7. The snap installation adaptor as claimed in claim 6, wherein:

said support is a rod support extending from said integrated block; and said integrated block and said rod support each comprise attachment pins to facilitate attachment of said snap installation adaptor to the handheld tool.

8. The snap installation adaptor as claimed in claim 1, wherein said attachment means comprise at least one attachment pin and at least one band capable of wrapping around the handheld tool and catching on said at least one attachment pin.

9. A snap installation kit for uniting a snap installation adaptor and a handheld tool such that the union is capable of permanently affixing snaps onto fabric, said kit comprising:

a snap installation adaptor, comprising:

an upper portion comprising a cap node sized, shaped, and dimensioned to hold one of a group consisting of a female cap, a male cap, or a male socket of the snap;

a lower portion comprising a socket node sized, shaped, and dimensioned to hold one of a group consisting of a female socket, a male cap, or a male socket of the snap;

an intermediate portion connecting said upper portion and said lower portion; and means for transferring external downward force from the handheld tool through said upper portion such that said cap node of said upper portion is forced to meet said socket node of said lower portion;

wherein:

said upper portion, said lower portion, and said intermediate portion of said snap installation adaptor are integrated into an integrated block and said integrated block further comprises a driving apparatus extension above said upper portion, wherein said driving apparatus extension houses said means for transferring external downward force and wherein said driving apparatus extension comprises a top;

said means for transferring external downward force of said snap installation adaptor comprises a threaded drive screw in communication with said cap node of said upper portion and capable of moving within and through said driving apparatus extension and said upper portion such that when no external downward force is applied, said threaded drive screw is housed entirely within said driving apparatus extension and said upper portion and when external downward force is applied, said threaded drive screw extends below said upper portion causing said cap node to be in contact with said socket node of said lower portion;

a handheld tool capable of exerting automated strong downward force through the use of a trigger, wherein said handheld tool has been modified so as to remove an original specific function of an unhandheld tool and leave a function capable of exerting automated strong downward force, comprising:

a portable power source;

a trigger for automatically executing the exertion of strong downward force; and means for attaching said snap installation adaptor and said handheld tool such that the automated strong downward force of said handheld tool is able to be transferred through said upper portion of said snap installation adaptor such that said cap node of said upper portion is forced to meet said socket node of said lower portion; and a drive rod sized and dimensioned to snugly fit within said threaded drive screw of said snap installation adaptor such that said drive rod is capable of being positioned within said threaded drive screw and applying downward force through said upper portion of said snap installation adaptor.

10. The snap installation kit as claimed in claim 9, wherein said handheld tool further comprises a collet capable of attaching and removing said drive rod from said handheld tool.

11. The snap installation kit as claimed in claim 9, wherein said attachment means comprise at least one attachment pin comprised by said snap installation adaptor and at least one band capable of wrapping around said handheld tool and catching on said at least one attachment pin of said snap installation adaptor.

12. The snap installation kit as claimed in claim 9, wherein said snap installation adaptor further comprises a laser sight positioned so as to provide a visible laser beam between said upper portion and said lower portion that indicates on the fabric placed between said upper portion and said lower portion where the snap will be permanently affixed.

13. The snap installation kit as claimed in claim 9, wherein said snap installation adaptor further comprises a support for supporting the union of said snap installation adaptor and said handheld tool.

14. The snap installation kit as claimed in claim 9, further comprising:

a piece of fabric on which to permanently affix the snap;

at least one female cap of the snap; and at least one female socket of the snap.

15. A snap installation adaptor designed to be united with a handheld tool comprising a trigger that controls an automatic execution of an exertion of strong downward force, wherein the union is capable of permanently affixing snaps onto fabric, said snap installation adaptor comprising:

an upper portion comprising a cap node sized, shaped, and dimensioned to hold one of a group consisting of a female cap, a male cap, or a male socket of the snap;

a lower portion comprising a socket node sized, shaped, and dimensioned to hold one of a group consisting of a female socket, a male cap, or a male socket of the snap, wherein said lower portion further comprises a threaded screw for adjusting a distance between said socket node of said lower portion and said cap node of said upper portion;

an intermediate portion connecting said upper portion and said lower portion;

means for transferring external downward force from the handheld tool is able to be transferred through said upper portion such that said cap node of said upper portion is forced to meet said socket node of said lower portion; and means for attaching said snap installation adaptor and the handheld tool such that the automated strong downward force of the handheld tool is able to be transferred through said upper portion of said snap installation adaptor such that said cap node of said upper portion is forced to meet said socket node of said lower portion.

16. The snap installation adaptor as claimed in claim 15, wherein said upper portion, said lower portion, and said intermediate portion are integrated into an integrated block and said integrated block further comprises a driving apparatus extension above said upper portion, wherein said driving apparatus extension houses said means for transferring external downward force and wherein said driving apparatus extension comprises a top.

17. The snap installation adaptor as claimed in claim 16, wherein:

said means for transferring external downward force comprises a threaded drive screw in communication with said cap node of said upper portion and capable of moving within and through said driving apparatus extension and said upper portion such that when no external downward force is applied, said threaded drive screw is housed entirely within said driving apparatus extension and said upper portion, and when external downward force is applied, said threaded drive screw extends below said upper portion causing said cap node to be in contact with said socket node of said lower portion; and said driving apparatus extension further comprises stop pins and a ball, and said threaded drive screw comprises a screw shoulder, wherein:

said stop pins are proximate to said top of said driving apparatus extension and are positioned such that said stop pins stop said screw shoulder of said threaded drive screw from extending through said top of said driving apparatus extension; and said ball is positioned between said threaded drive screw and said upper portion such that when external downward force is applied, it is applied through said threaded drive screw and down onto said ball.

18. The snap installation adaptor as claimed in claim 15, further comprising a laser sight positioned so as to provide a visible laser beam between said upper portion and said lower portion that indicates on the fabric placed between said upper portion and said lower portion where the snap will be permanently affixed.

19. The snap installation adaptor as claimed in claim 15, wherein said upper portion comprises a placement device for holding one of a group consisting of a female cap, a male cap, and a male socket snap part of the snap in place within said cap node such that said one of said group is easily released upon the permanent affixation of said one of said group to the fabric.

20. The snap installation adaptor as claimed in claim 15, further comprising a support for supporting the union of said snap installation adaptor and the handheld tool.

21. A snap installation adaptor designed to be united with a handheld tool comprising a trigger that controls an automatic execution of an exertion of strong downward force, wherein the union is capable of permanently affixing snaps onto fabric, said snap installation adaptor comprising:

an upper portion comprising a cap node sized, shaped, and dimensioned to hold one of a group consisting of a female cap, a male cap, or a male socket of the snap;

a lower portion comprising a socket node sized, shaped, and dimensioned to hold one of a group consisting of a female socket, a male cap, or a male socket of the snap;

an intermediate portion connecting said upper portion and said lower portion;

means for transferring external downward force from the handheld tool is able to be transferred through said upper portion such that said cap node of said upper portion is forced to meet said socket node of said lower portion; and means for attaching said snap installation adaptor and the handheld tool such that the automated strong downward force of the handheld tool is able to be transferred through said upper portion of said snap installation adaptor such that said cap node of said upper portion is forced to meet said socket node of said lower portion, wherein said attachment means comprise at least one attachment pin and at least one band capable of wrapping around the handheld tool and catching on said at least one attachment pin.

22. The snap installation adaptor as claimed in claim 21, wherein said upper portion, said lower portion, and said intermediate portion are integrated into an integrated block and said integrated block further comprises a driving apparatus extension above said upper portion, wherein said driving apparatus extension houses said means for transferring external downward force and wherein said driving apparatus extension comprises a top.

23. The snap installation adaptor as claimed in claim 22, wherein:

said means for transferring external downward force comprises a threaded drive screw in communication with said cap node of said upper portion and capable of moving within and through said driving apparatus extension and said upper portion such that when no external downward force is applied, said threaded drive screw is housed entirely within said driving apparatus extension and said upper portion, and when external downward force is applied, said threaded drive screw extends below said upper portion causing said cap node to be in contact with said socket node of said lower portion; and said driving apparatus extension further comprises stop pins and a ball, and said threaded drive screw comprises a screw shoulder, wherein:

said stop pins are proximate to said top of said driving apparatus extension and are positioned such that said stop pins stop said screw shoulder of said threaded drive screw from extending through said top of said driving apparatus extension; and said ball is positioned between said threaded drive screw and said upper portion such that when external downward force is applied, it is applied through said threaded drive screw and down onto said ball.

24. The snap installation adaptor as claimed in claim 21, further comprising a laser sight positioned so as to provide a visible laser beam between said upper portion and said lower portion that indicates on the fabric placed between said upper portion and said lower portion where the snap will be permanently affixed.

25. The snap installation adaptor as claimed in claim 21, wherein said lower portion comprises a threaded screw for adjusting a distance between said socket node of said lower portion and said cap node of said upper portion.

26. The snap installation adaptor as claimed in claim 21, wherein said upper portion comprises a placement device for holding one of a group consisting of a female cap, a male cap, and a male socket snap part of the snap in place within said cap node such that said one of said group is easily released upon the permanent affixation of said one of said group to the fabric.

27. The snap installation adaptor as claimed in claim 21, further comprising a support for supporting the union of said snap installation adaptor and the handheld tool.

* * * * *